US009402134B2

(12) United States Patent
Yang et al.

(10) Patent No.: US 9,402,134 B2
(45) Date of Patent: Jul. 26, 2016

(54) MANUFACTURING METHOD FOR STIFFENED DIAPHRAGM AND THE MANUFACTURED DIAPHRAGM USING SAME

(71) Applicant: MERRY ELECTRONICS (SUZHOU) CO., LTD., Suzhou, Jiangsu Province (CN)

(72) Inventors: Chen-Mao Yang, Taichung (TW); Ching-Lan Lin, Taichung (TW); Po-Yu Chen, Taichung (TW); Yi-Lin Hsieh, Taichung (TW); Feng-Min Lai, Taichung (TW)

(73) Assignee: MERRY ELECTRONICS (SUZHOU) CO., LTD. (CN)

( * ) Notice: Subject to any disclaimer, the term of this patent is extended or adjusted under 35 U.S.C. 154(b) by 0 days.

(21) Appl. No.: 14/491,398

(22) Filed: Sep. 19, 2014

(65) Prior Publication Data

US 2016/0088394 A1 Mar. 24, 2016

(51) Int. Cl.

| | |
|---|---|
| ***H04R 7/20*** | (2006.01) |
| ***H04R 7/02*** | (2006.01) |
| ***H04R 31/00*** | (2006.01) |

(52) U.S. Cl.

CPC ..... *H04R 7/02* (2013.01); *H04R 31/003* (2013.01)

(58) Field of Classification Search

CPC ..... H04R 7/20; H04R 7/12

USPC ..... 181/157, 167, 173

See application file for complete search history.

(56) References Cited

U.S. PATENT DOCUMENTS

| | | | | |
|---|---|---|---|---|
| 3,247,927 | A * | 4/1966 | Cragg | 181/168 |
| 4,122,314 | A * | 10/1978 | Matsuda et al. | 381/425 |
| 4,565,905 | A * | 1/1986 | Nation | 381/186 |
| 5,102,729 | A * | 4/1992 | Yamaguchi et al. | 442/147 |
| 9,173,033 | B1 * | 10/2015 | Lin et al. | |
| 2004/0195039 | A1 * | 10/2004 | Sahyoun | 181/157 |
| 2005/0051380 | A1 * | 3/2005 | Takayama et al. | 181/170 |
| 2006/0249327 | A1 * | 11/2006 | Sato et al. | 181/167 |
| 2007/0235251 | A1 * | 10/2007 | Ono | 181/169 |
| 2008/0006475 | A1 * | 1/2008 | Imanishi et al. | 181/167 |
| 2011/0194723 | A1 * | 8/2011 | Lin et al. | 381/396 |

* cited by examiner

*Primary Examiner* — Forrest M Phillips
(74) *Attorney, Agent, or Firm* — Bacon & Thomas, PLLC

(57) ABSTRACT

A stiffened diaphragm manufacturing method and the manufactured diaphragm using same are provided. The manufacturing method includes the steps of: applying a hot glue layer to a side of a stiffened plate; putting a base layer on the hot glue layer, and then heating and adhering the base layer and the stiffened plate together; and performing a pressing process on the base layer and the stiffened plate to form a diaphragm having a central portion and a surround portion. The stiffened plate is coated uniformly with the hot glue layer and then put on the base layer to undergo heating and adhesion; hence, an oversupply or undersupply of a glue will be unlikely to happen. Furthermore, the manufacturing process is simple and attains high-strength adhesion between the stiffened plate and the base layer.

13 Claims, 2 Drawing Sheets

MANUFACTURING METHOD FOR STIFFENED DIAPHRAGM AND THE MANUFACTURED DIAPHRAGM USING SAME

BACKGROUND OF THE INVENTION

1. Technical Field

The present invention relates to diaphragms of speakers, and more particularly, to a manufacturing method effective in adhering a stiffened plate and a base layer to each other tightly and shaping the stiffened plate and the base layer and to the diaphragm thus manufactured.

2. Description of Related Art

The recent development of smartphones is accompanied by a surge of research and development (R&D) of micro speakers. To enable speakers to generate sound which has satisfactory acoustic properties, a wide variety of diaphragm materials are being developed unceasingly. Some of the speakers are equipped with a composite diaphragm.

A conventional composite diaphragm manufacturing method involves: pre-shaping a base layer by a pressing process such that the base layer forms a central portion and a surround portion disposed along the periphery of the central portion; providing a stiffened plate; cutting the stiffened plate according to the dimensions and shape of the central portion; positioning the stiffened plate on the central portion; and adhering the stiffened plate to the base layer. After the stiffened plate and the base layer have been adhered together, the diaphragm has enhanced rigidity. Therefore, the diaphragm could provide optimal acoustic performance, and better high frequency sensing.

However, during the conventional composite diaphragm manufacturing process, the stiffened plate must be aligned with the central portion of the base layer in order for the stiffened plate to be adhered to the central portion snugly. However, in doing so, not only is the manufacturing process becomes intricate, but the yield is also reduced. Moreover, the conventional manufacturing method is flawed with the tendency of a glue to be excessive or insufficient. A glue oversupplied is likely to overflow the stiffened plate and thus compromise the overall sensitivity of the diaphragm. A glue undersupplied predisposes the central portion and the stiffened plate to inadequate adhesion strength, thereby causing the stiffened plate to come off the central portion whenever the diaphragm vibrates vigorously.

SUMMARY OF THE INVENTION

In view of the aforesaid drawbacks of the prior art, it is an objective of the present invention to provide a stiffened diaphragm manufacturing method which is conducive to the simultaneous shaping of a stiffened plate and a base layer, and the prevention of an oversupply or undersupply of a glue during an adhering process, effectuates high-strength adhesion between the stiffened plate and the base layer, and requires a simple manufacturing process.

In order to achieve the above and other objectives, the present invention provides a stiffened diaphragm manufacturing method comprising the steps of: applying a hot glue layer to a side of a stiffened plate; putting a base layer on the hot glue layer, and then heating and adhering the base layer and the stiffened plate together; and performing a pressing process on the base layer and the stiffened plate to form a diaphragm.

The present invention further provides a stiffened diaphragm suitable for the aforesaid method. The stiffened diaphragm comprises a base layer and a stiffened plate. The base layer has a central portion and a surround portion surrounding and adjoining the central portion. The stiffened plate has a top side coated with a stiffened glue layer and has a bottom side coated with a hot glue layer so as for the stiffened plate to adhere to the central portion.

The stiffened plate is coated uniformly with a hot glue layer and then put on the base layer to undergo heating and adhesion. Hence, not only is the hot glue layer uniform and its thickness under control, but an oversupply or undersupply of a glue is unlikely to occur. Moreover, it is only when the manufacturing process of the present invention comes to the end of its course that the base layer and the stiffened plate which have adhered together undergo a pressing process, such that the stiffened plate and the base layer are concurrently shaped. Furthermore, the stiffened diaphragm manufacturing method of the present invention is not confronted with any problem with the positioning of the base layer and the stiffened plate and thus not only requires just a simple manufacturing process.

DETAILED DESCRIPTION OF THE EMBODIMENT OF THE INVENTION

Figure 1:
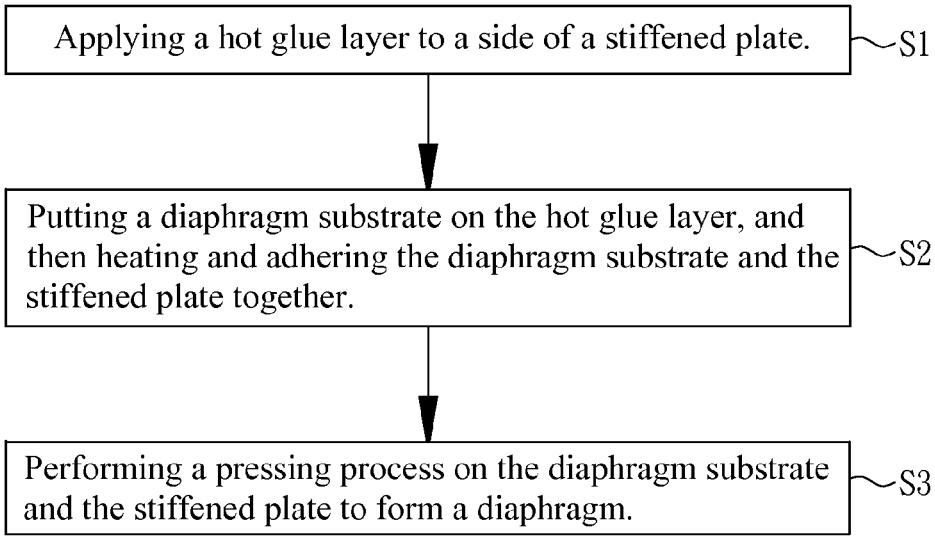
FIG. 1 is a flow chart of a manufacturing method according to a preferred embodiment of the present invention.

To enable persons skilled in the art to gain insight into the features of the present invention, the present invention is hereunder illustrated with a preferred embodiment and drawings. Referring to FIG. 1, according to the present invention, a stiffened diaphragm manufacturing method comprises the steps of:

Step S1 involves coating a hot glue (also known as hot-melt adhesive) layer uniformly on a side of a stiffened plate by roll coating, and coating a stiffened glue layer optionally on an opposing side of the stiffened plate by roll coating so as to enhance the rigidity of the stiffened plate. The hot glue is made of a conventional material, such as alkene polymer or polyvinyl alcohol (PVA). The stiffened glue layer is, for example, made from a thermosetting plastic, a UV curable plastic, or a mixture of a hard material, such as carbon nanotube or nano ceramic powder, and a glue material. The stiffened plate coated with the stiffened glue layer is irradiated by UV or baked to cure the stiffened glue layer and increase the rigidity of the stiffened plate.

After both the hot glue layer and the stiffened glue layer have been cured, the stiffened plate is cut to appropriate shape (i.e., round, as illustrated in this embodiment and shown in FIG. 2) and dimensions. Persons skilled in the art can selectively cut the stiffened plate to specific dimensions and shape which are not restricted to this embodiment. Step S2 involves putting the stiffened plate on a base layer, fixing the stiffened plate and the base layer in place with a positioning jig (not shown) in a manner to allow the hot glue layer and the base layer to come into contact with each other, and conveying the base layer and the stiffened plate to an oven for baking, such that the hot glue layer melts and adheres to the base layer.

Figure 2:
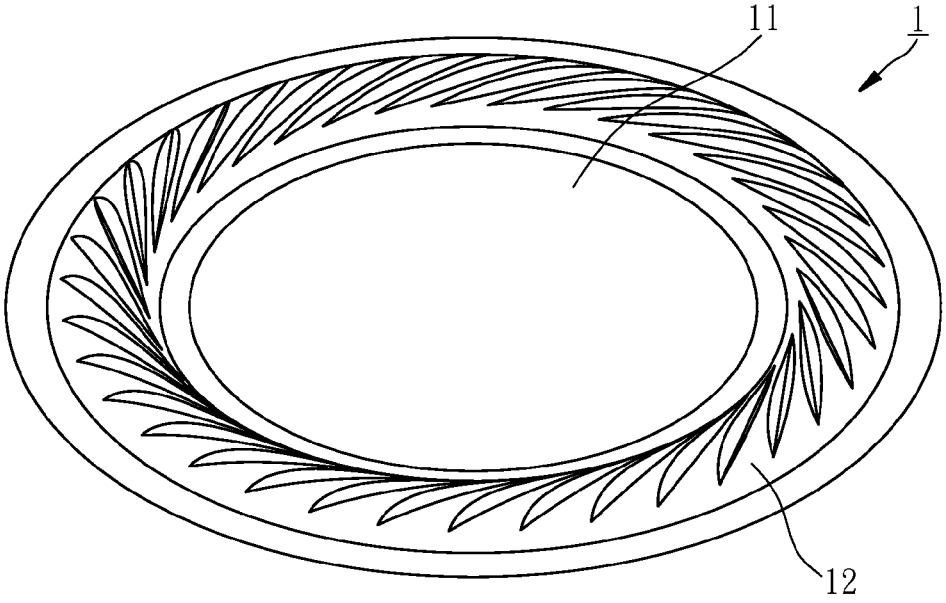
FIG. 2 is a perspective view of a diaphragm according to a preferred embodiment of the present invention.

Step S3, which begins as soon as the adhesion in step S2 is achieved, involves pressing the base layer and the stiffened plate, which are fixed in place with the positioning jig and adhered to each other, by hot pressing or pneumatic pressing with a diaphragm-forming pressing die to form a diaphragm 1 having a central portion 11 and a surround portion 12 (shown in FIG. 2). In this embodiment, the stiffened plate covers the central portion 11 only.

The stiffened plate is coated uniformly with the hot glue layer in step S1 and then put on the base layer to undergo heating and adhesion in step S2. Hence, an oversupply or undersupply of glue will be unlikely to happen to the manufacturing process of the present invention, provided that the glue layers are uniform and not overly thick. Therefore, the manufacturing method of the present invention exercises better control over the amount of the hot glue supplied the thickness of the hot glue layer, and the uniformity of the hot glue layer than conventional manufacturing methods do. Moreover, it is only when step S3 begins that the base layer and the stiffened plate which have adhered to each other undergo a pressing process; in other words, before it undergoes a pressing process, the base layer is just a flat plate without the central portion 11 and the surround portion 12. Furthermore, it is only when the manufacturing process of the present invention comes to the end of its course that the diaphragm 1 is formed by a pressing process. Unlike conventional diaphragm manufacturing methods, the stiffened diaphragm manufacturing method of the present invention is not confronted with any problem with the positioning of the base layer and the stiffened plate and thus not only requires just a simple manufacturing process but also increases the production yield.

It's noted there. In step S1, the purpose of coating the hot glue layer and the stiffened glue layer by roll coating is to ensure the uniformity of the glue layers. To this end, persons skilled in the art may also adopt any other common means of coating without being restricted to this embodiment. Moreover, in step S2 or step S3, persons skilled in the art can also fix the stiffened plate and the base layer in place with a positioning jig to make sure that the stiffened plate is centrally disposed.

Moreover, persons skilled in the art can also selectively make the base layer and the stiffened plate from the same material to increase the strength of adhesion between the base layer and the stiffened plate.

Figure 3:
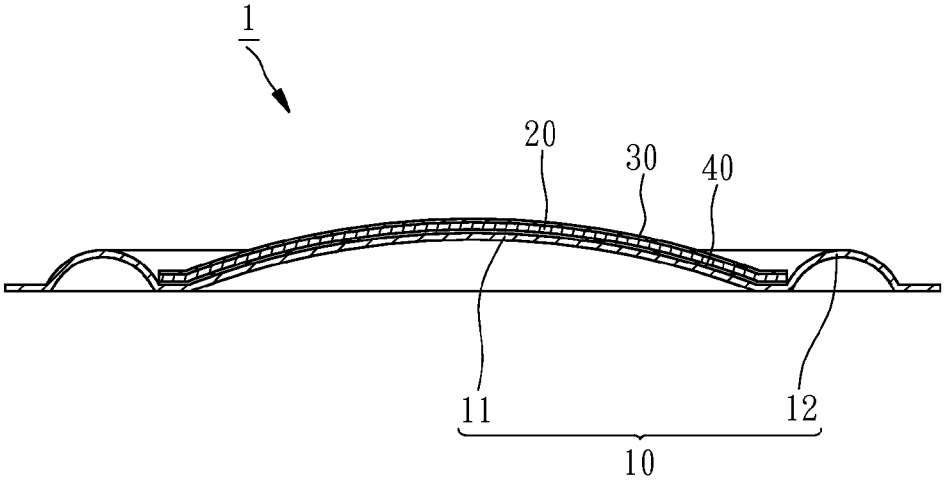
FIG. 3 is a cross-sectional view of FIG. 2.

Referring to FIG. 3, the diaphragm 1 manufactured by the aforesaid manufacturing method comprises a base layer 10 and a stiffened plate 20, both of which are round. The base layer 10 has a central portion 11 and a surround portion 12 which surrounds and adjoins the central portion 11. The stiffened plate 20 has a top side coated with a stiffened glue layer 30 and a bottom side coated with a hot glue layer 40. The stiffened plate 20 adheres to the central portion 11 through the hot glue layer 40.

The constituent elements disclosed in the aforesaid embodiments of the present invention are illustrative rather than restrictive of the scope of the present invention. Any other readily conceivable structural changes and equivalent element replacements and changes to the aforesaid embodiments of the present invention must be interpreted as falling within the claims of the present invention.

What is claimed is:

1. A stiffened diaphragm manufacturing method, comprising the steps of:

a) applying a hot glue layer and a stiffened glue layer to two opposite sides of a stiffened plate respectively;

b) putting the stiffened plate on a base layer, and then heating and adhering the base layer and the stiffened plate together; and c) performing a pressing process on the base layer and the stiffened plate to form a diaphragm.

2. The method of claim 1 wherein the diaphragm is for a micro-speaker.

3. The stiffened diaphragm manufacturing method of claim 1, wherein the stiffened glue layer is made of one of a thermosetting plastic, a UV curable plastic, a mixture of a thermosetting plastic and carbon nanotube or nano ceramic powder, and a mixture of a UV curable plastic and carbon nanotube or nano ceramic powder.

4. The stiffened diaphragm manufacturing method of claim 1, wherein step a) further comprises coating the stiffened glue layer by roll coating.

5. The stiffened diaphragm manufacturing method of claim 1, wherein step a) further comprises coating the hot glue layer by roll coating.

6. The stiffened diaphragm manufacturing method of claim 1, wherein, in step b), the base layer and the stiffened plate are fixed in place with a positioning jig before being heated and adhered together.

7. The stiffened diaphragm manufacturing method of claim 1, wherein, in step c), the stiffened plate and the base layer are fixed in place with a positioning jig before undergoing a pressing process.

8. The stiffened diaphragm manufacturing method of claim 1, wherein, in step c), the pressing process is performed by one of pneumatic pressing and hot pressing.

9. The stiffened diaphragm manufacturing method of claim 1, wherein the stiffened plate and the base layer are made of a same material.

10. The stiffened diaphragm manufacturing method of claim 1, wherein the stiffened plate is round.

11. A stiffened diaphragm, comprising:

a base layer having a central portion and a surround portion surrounding and adjoining the central portion;

a stiffened plate having a top side coated with a stiffened glue layer and a bottom side coated with a hot glue layer so as for the stiffened plate to adhere to the central portion of base layer; and wherein the base layer and the stiffened plate are bonded with each other and formed a curved profile jointly.

12. The stiffened diaphragm of claim 11, wherein the stiffened glue layer is made of one of a thermosetting plastic, a UV curable plastic, a mixture of a thermosetting plastic and carbon nanotube or nano ceramic powder, and a mixture of a UV curable plastic and carbon nanotube or nano ceramic powder.

13. The stiffened diaphragm of claim 11, for a micro-speaker.

* * * * *